US011180267B2

(12) United States Patent
Schuttler et al.

(10) Patent No.: US 11,180,267 B2
(45) Date of Patent: Nov. 23, 2021

(54) APPARATUS AND METHOD OF GENERATING A FASTENER AND SECURING AT LEAST ONE PRODUCT TO AT LEAST ONE PACKAGING

(71) Applicant: Avery Dennison Corporation, Glendale, CA (US)

(72) Inventors: David L. Schuttler, Townsend, MA (US); Charles J. Burout, III, Bedford, NH (US); Thomas F. Shilale, Douglas, MA (US)

(73) Assignee: Avery Dennison Corporation, Glendale, CA (US)

( * ) Notice: Subject to any disclaimer, the term of this patent is extended or adjusted under 35 U.S.C. 154(b) by 92 days.

(21) Appl. No.: 16/473,865

(22) PCT Filed: Dec. 28, 2017

(86) PCT No.: PCT/US2017/068747
§ 371 (c)(1),
(2) Date: Jun. 26, 2019

(87) PCT Pub. No.: WO2018/126030
PCT Pub. Date: Jul. 5, 2018

(65) Prior Publication Data

US 2019/0344913 A1 Nov. 14, 2019

Related U.S. Application Data

(60) Provisional application No. 62/440,114, filed on Dec. 29, 2016.

(51) Int. Cl.

| | |
|---|---|
| ***B65B 15/00*** | (2006.01) |
| ***B65B 59/00*** | (2006.01) |
| *B65B 59/02* | (2006.01) |

(52) U.S. Cl.
CPC ..... *B65B 15/00* (2013.01); *B65B 59/003* (2019.05); *B65B 59/02* (2013.01)

(58) Field of Classification Search
CPC ..... B65B 13/34; B65B 13/345; B65B 15/00; B65B 15/02; B65D 73/0007; B65D 73/0014; B65C 7/003; B65C 7/005
(Continued)

(56) References Cited

U.S. PATENT DOCUMENTS

| | | | |
|---|---|---|---|
| 1,998,135 | A | 4/1935 | Heinz |
| 2,752,997 | A | 7/1956 | Soave |

(Continued)

FOREIGN PATENT DOCUMENTS

| | | |
|---|---|---|
| CA | 1159795 | 1/1984 |
| CN | 2193249 | 3/1995 |

(Continued)

OTHER PUBLICATIONS

Avery Dennison TM IndES® Elastic Staple® System, http://pfs.averydennison.com/en/home/products/fasteners/IndES-elastic-staple.html, Mar. 31, 2017.

(Continued)

*Primary Examiner* — Stephen F. Gerrity

(57) ABSTRACT

A method and apparatus for constructing fasteners of various lengths and using the fasteners to secure at least one product to at least one packaging. The apparatus comprises as applicator module and a needle for engaging or attaching a plurality of T-bar elements to a filament. A user employs the apparatus to engage or attach a first T-bar element to the filament at a first position within the packaging. The filament is then stretched across at least one product, and a second T-bar element is engaged or attached to the filament at a
(Continued)

second position within at least one packaging. The filament is cut leaving the fastener in place securing the product to the packaging.

30 Claims, 3 Drawing Sheets

(58) Field of Classification Search
USPC ..... 53/414, 416, 139.4; 206/495; 227/67
See application file for complete search history.

(56) References Cited

U.S. PATENT DOCUMENTS

| | | | | |
|---|---|---|---|---|
| 3,241,255 | A | 3/1966 | Hanley | |
| 3,353,227 | A * | 11/1967 | Kabel | B65B 13/345 24/16 PB |
| 3,422,499 | A | 1/1969 | Merser | |
| 3,633,633 | A | 1/1972 | Countryman | |
| 3,783,783 | A | 1/1974 | Hamisch | |
| 3,850,297 | A | 11/1974 | Merser | |
| 4,323,183 | A | 4/1982 | Duchin | |
| 4,461,738 | A | 7/1984 | Russell | |
| 4,487,354 | A | 12/1984 | Ueno | |
| 4,582,236 | A * | 4/1986 | Hirose | A41D 27/245 227/152 |
| 5,038,931 | A | 8/1991 | Kunreuther | |
| 5,292,048 | A | 3/1994 | Vanderwiel | |
| 5,438,724 | A | 8/1995 | Merser | |
| 5,671,507 | A | 9/1997 | Deschenes et al. | |
| 5,743,574 | A | 4/1998 | Kohn | |
| 5,799,425 | A | 9/1998 | Merser et al. | |
| 5,813,588 | A | 9/1998 | Lin | |
| 6,180,205 | B1 | 1/2001 | Tachauer et al. | |
| 6,212,741 | B1 | 4/2001 | Cahill | |
| 6,527,030 | B2 | 3/2003 | Ueno | |
| 6,533,155 | B1 | 3/2003 | Kubota et al. | |
| 6,561,405 | B2 * | 5/2003 | Flannery et al. | B65C 7/003 227/67 |
| 6,561,406 | B1 * | 5/2003 | Furutsu et al. | B65C 7/005 227/67 |
| 6,732,899 | B2 * | 5/2004 | Franks | B65C 7/003 227/107 |
| 6,892,920 | B2 | 5/2005 | Kunreuther | |
| 7,587,796 | B1 | 9/2009 | Schultz | |
| 7,807,244 | B2 | 10/2010 | Line | |
| 8,695,799 | B2 | 4/2014 | Cooper et al. | |
| 9,199,756 | B2 | 12/2015 | Cooper | |
| 2003/0218043 | A1 * | 11/2003 | Cooper et al. | B65C 7/005 227/67 |
| 2004/0035904 | A1 | 2/2004 | Kunreuther | |
| 2005/0001006 | A1 * | 1/2005 | Ueno | B65C 7/00 227/67 |
| 2005/0125958 | A1 | 6/2005 | Deschenes et al. | |
| 2005/0178037 | A1 | 8/2005 | Kunreuther | |
| 2008/0164271 | A1 * | 7/2008 | Cooper et al. | B65C 7/00 221/1 |
| 2008/0190956 | A1 * | 8/2008 | Earley et al. | B65C 7/003 221/74 |
| 2012/0159903 | A1 | 6/2012 | Cooper et al. | |
| 2014/0001227 | A1 | 1/2014 | McNeill et al. | |
| 2014/0165363 | A1 | 6/2014 | Cooper | |
| 2015/0228212 | A1 | 8/2015 | Bejian | |

FOREIGN PATENT DOCUMENTS

| | | | | |
|---|---|---|---|---|
| CN | 1535230 | | 10/2004 | |
| CN | 201105548 | | 8/2008 | |
| CN | 103862427 | | 6/2014 | |
| DE | 592853 | C * | 2/1934 | B65B 15/02 |
| DE | 3118923 | | 4/1982 | |
| DE | 3516174 | | 11/1985 | |
| DE | 9216863 | | 3/1993 | |
| FR | 1347704 | | 1/1964 | |
| GB | 2085348 | | 4/1982 | |
| WO | 8704554 | | 7/1987 | |

OTHER PUBLICATIONS

International Search Report and Written Opinion issued in corresponding IA No. PCT/US2017/068747 dated Mar. 28, 2019.

International Preliminary Report on Patentability issued in IA No. PCT/US2017/068747 dated Feb. 7, 2019.

Avery DennisonTM Swiftach® Systems, http://www.westernstates.net/Fasteners/fasteners.html, 1999.

* cited by examiner

FIG. 3A
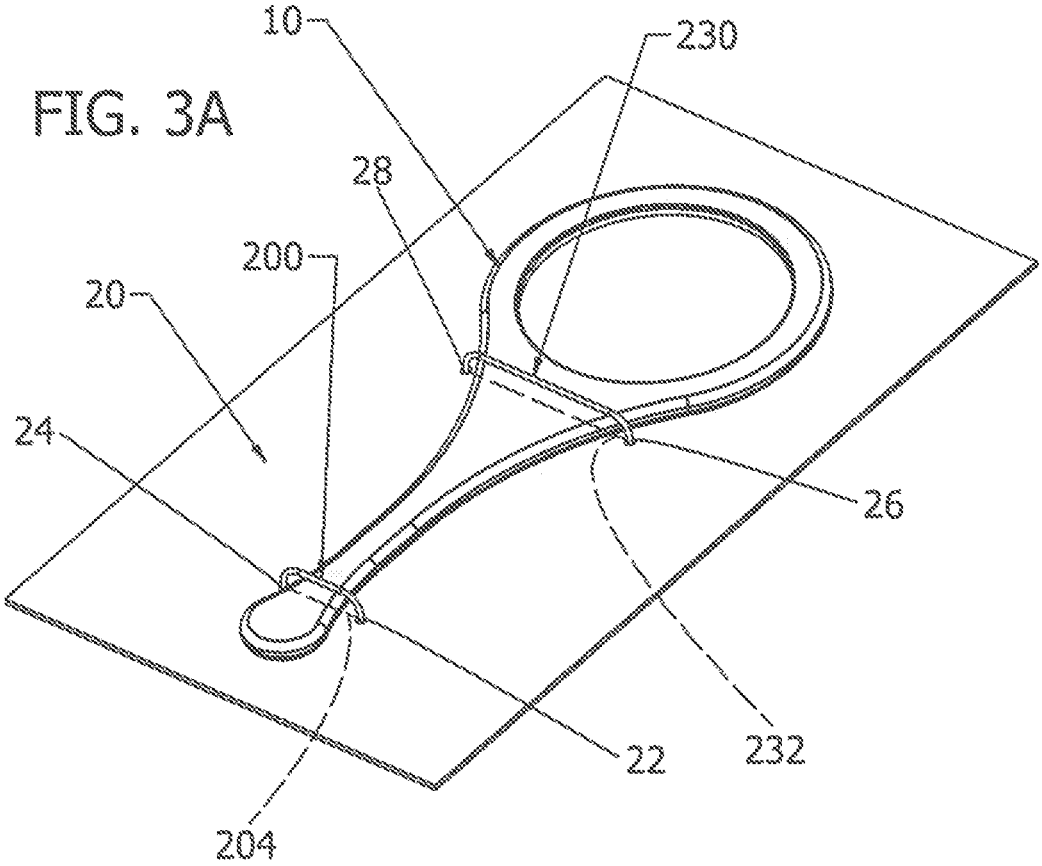
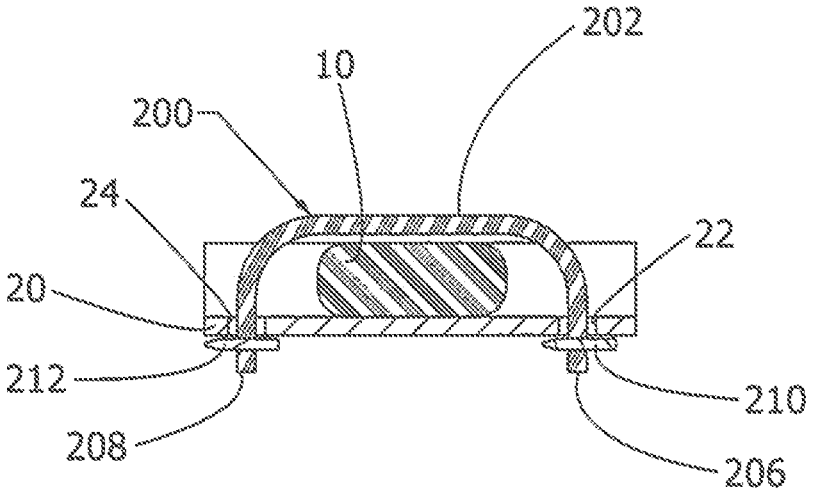
FIG. 3B

APPARATUS AND METHOD OF GENERATING A FASTENER AND SECURING AT LEAST ONE PRODUCT TO AT LEAST ONE PACKAGING

CROSS-REFERENCE TO RELATED APPLICATION

The present application is a 371 of International Application No. PCT/US17/68747, which was published in English on Jul. 5, 2018, and claims the benefit of U.S. Provisional Patent Application No. 62/440,114 filed Dec. 29, 2016, both of which are incorporated herein by reference in their entireties.

BACKGROUND

The present disclosure relates generally to fasteners and systems for securing products to packaging. More particularly, the present disclosure relates to a system for attaching products to packaging employing a variety of different length elastic fasteners without the need to modify the system when selecting different lengths of fasteners.

Elastic fasteners are widely used to secure a variety of products to packaging material, such as, but not limited to, cardboard or plastic backing. While elastic fasteners (also referred to herein as elastic staples) are somewhat flexible, products often require a range of different length staples to secure irregularly shaped products to the packaging at different positions. Existing elastic staple applicators require preformed fixed length fasteners to attach the product to the packaging material. Unfortunately, a number of different length fasteners are often required to satisfy different sized applications. Currently, a user must stop the machine and replace the loaded fastener stock with a different length fastener stock to complete the job drastically slowing the entire process. Alternatively, the product and packaging would have to move to additional machines loaded with the different length fasteners to complete a single job.

Thus, there exists a need for a fastening system capable of producing fasteners of a variety of different lengths. The present disclosure provides an apparatus and process that generates a variety of different length elastic fasteners for securing a product to a packaging material without the need to interrupt the process and change out the fastener stock with different length fastener stock. The system generates elastic fasteners of varying lengths without using preformed fasteners. Fasteners are individually manufactured as they are concurrently attaching products to packaging.

SUMMARY

The following presents a simplified summary in order to provide a basic understanding of some embodiments described in the detailed description. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a method of generating a fastener and using the fastener to secure at least one product to at least one packaging. As described herein, the fastener may be secured to one product or a plurality of products within the packaging. Further, the fastener may be secured to multiple portions of at least one packaging. In many embodiments, there may be more than one product secured by the fastener.

In many embodiments, the method uses an apparatus comprising an applicator module and a needle. In some embodiments, the method comprises: 1) stocking an apparatus with a filament and a plurality of T-bar elements (as described herein, comprises at least a first T-bar element and a second T-bar element); 2) penetrating the packaging with the needle at a first position; 3) deploying the filament and a first T-bar element through the needle; and 4) engaging the first T-bar element to the filament at the first position.

In some embodiments, the applicator may feed the needle with a plurality of T-bar elements. The filament may then be fed through the applicator module and may interact with the needle. Further, the needle may then penetrate the packaging at a first position and may inject a first T-bar element into or around the filament and through the packaging. In some embodiments, the first T-bar element may be oriented substantially perpendicular to the filament once engaged or attached to the filament. In many embodiments, when the first T-bar element may be substantially perpendicularly engaged or attached to the filament at the first position, it may then be secured to the packaging. In some embodiments, the needle may then be moved to a second position while stretching the filament across at least one product and may be inserted at the second position. A second T-bar element may then be injected into or around the filament and through the packaging by the needle. In some embodiments, the second T-bar element may be oriented substantially perpendicular to the filament once engaged or attached to the filament. In many embodiments, when the second T-bar element may be substantially perpendicularly engaged or attached to the filament at the second position, it may then be secured to the packaging. The filament may then be severed at the second position distal to the second T-bar element, thereby generating an elastic fastener securing at least one product to at least one packaging.

In one embodiment, the apparatus generates a plurality of elastic fasteners each comprising a filament section (comprising a first end, a second end, and a length), a first T-bar element, and a second T-bar element. Each elastic fastener may be used to secure at least one product to at least one packaging at the first position and the second position. The apparatus is then capable of generating a different length elastic fastener for an application where a longer or shorter fastener may be desired. In some embodiments, the different length elastic or fastener may secure at least one product to the packaging, and may also include the step of securing at least one additional fastener to the packaging (e.g., at third and fourth positions).

In many embodiments, an apparatus for constructing a plurality of different length fasteners may comprise: 1) a needle; and 2) an applicator module; wherein the fasteners are generated and used to secure at least one product to at least one packaging using the methods described herein.

Also described herein is an apparatus for constructing a plurality of different length fasteners comprising: 1) a needle; and 2) an applicator module, wherein the applicator module may feed a filament, and the filament may interact with the needle, thereby ejecting a first T-bar element and a second T-bar element through the needle, and then the first T-bar element and the second T-bar element engage with the filament at a first position and a second position respectively.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

FIG. 3A illustrates a perspective view of a product secured to the packaging with two fasteners of varying length in accordance with the disclosed architecture.

FIG. 3B illustrates a sectional view of the product through a centerline created by fastener 200 of FIG. 3A, and secured to the packaging with said fastener of the desired length in accordance with the disclosed architecture.

DETAILED DESCRIPTION

Figure 1:
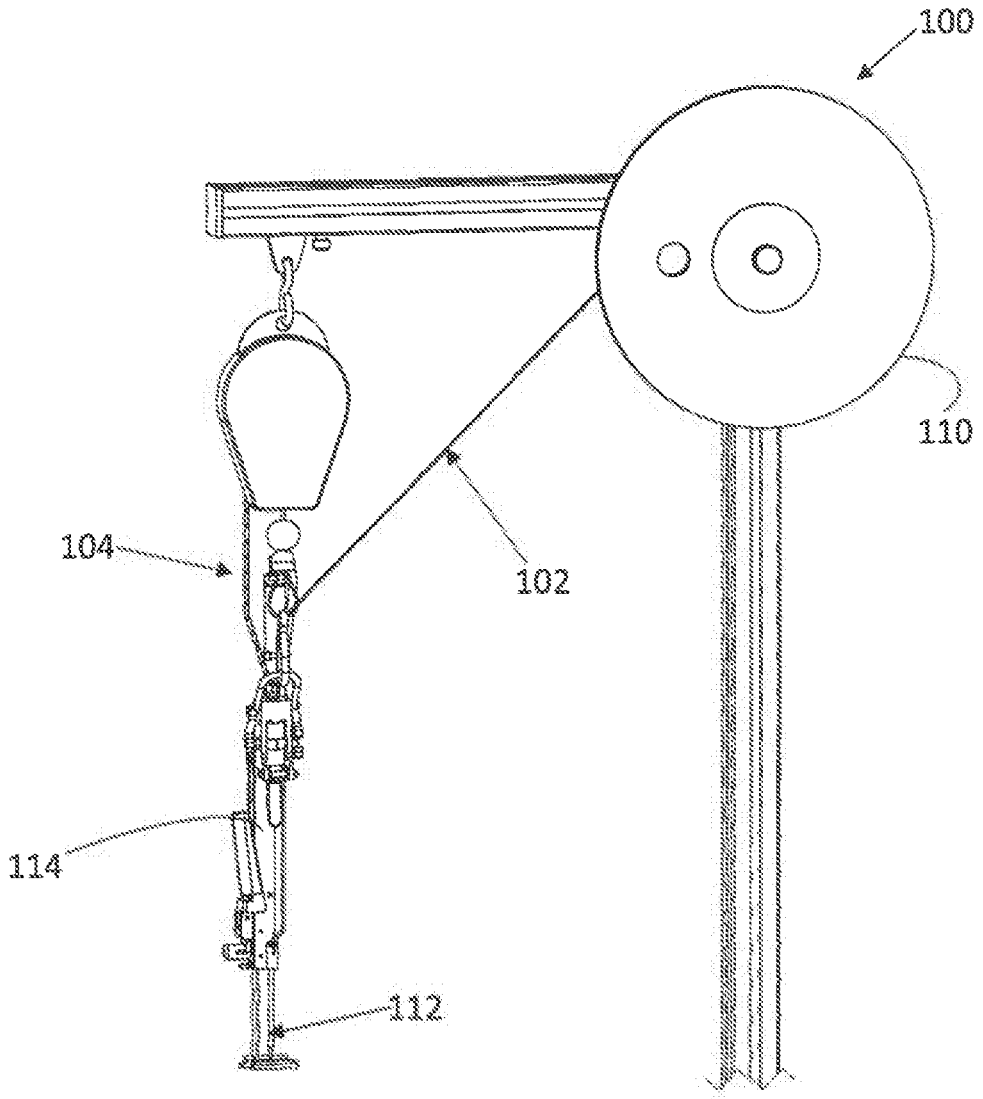
FIG. 1 illustrates a perspective view of an apparatus for generating a fastener of a desired length and securing a product to a packaging in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that what is described herein can be practiced without these specific details. In other instances, well-known structures and devices are shown in block diagram form in order to facilitate a description thereof.

In one embodiment, an apparatus for manufacturing a fastener for securing a product to packaging and a method of using the same. Irregularly shaped products are commonly secured to a backing or other packaging material such as cardboard, or other similar rigid material. One problem with traditional methods of securing these types of products is that they often require a variety of different length fasteners to adequately secure the product to the packaging. In many embodiments, the method disclosed herein generates fasteners of different lengths using an apparatus with a single setup of stock material.

Referring initially to the drawings, FIG. 1 illustrates an apparatus 100 for generating a fastener 200, also referred to as an elastic staple, to engage, attach, or otherwise secure at least one product 10 to at least one packaging 20. The apparatus 100 utilizes a filament 102 and a plurality of T-bar elements 104 to manufacture the fastener 200.

In many embodiments, the apparatus for constructing a plurality of different length fasteners may comprise: 1) a needle; and 2) an applicator module, wherein the fasteners are generated and used to secure at least one product to at least one packaging using the methods described herein.

In some embodiments, the apparatus 100 may comprise a needle 112 and an applicator module 114. The apparatus 100 builds and deploys a plurality of the fasteners 200, wherein each fastener 200 (shown in FIG. 2) may have a different length as described infra.

The applicator module 114 may serve to provide the plurality of T-bar elements 104 and filaments 102 needed to manufacture the fasteners. In many embodiments, the applicator module 114 may also deploy the plurality of T-bar elements 104. In many embodiments, the applicator module 114 may further engage or attach the plurality of T-bar elements 104 to the filament 102.

In many embodiments, the applicator module 114 additionally may accept the filament 102 from the spool 110 and then feed the filament 102 through the applicator module and interact with the needle 112. The applicator module 114 synchronously ejects each of the plurality of T-bar elements 104 through the needle 112 separate from the filament 102. The applicator module 114 may comprise a deployment activator (not shown in FIG. 1), such as a button, switch, trigger, or the like, located on the applicator module 114. The applicator module 114 further comprises a cutting component (not shown in FIG. 1) for severing the filament 102 and separating individual fasteners. Similarly, the cutting component may be activated by a cutting activator (not shown), such as a button, switch, trigger, or the like, located on the applicator module 114.

In some embodiments, the applicator module 114 feeds a filament 102 through the applicator module and interacts with the needle 112. Then, the applicator module 114 may eject a first T-bar element and a second T-bar element (shown in detail in FIG. 2) through the needle 112. Further, in some embodiments, the applicator module 114 then engages or attaches the first T-bar element and the second T-bar element to the filament 102 at a first position and a second position (described in FIG. 3B).

In many embodiments, the apparatus may further comprise a spool 110 for retaining the filament 102. In many embodiments, the spool 110 may also pre-tension the filament 102 as it enters into applicator module 114. Pre-tensioning filament 102 may be desirable when engaging or attaching the first t-bar element and second t-bar element. In some embodiments and as shown in FIG. 1, the filament 102 may be supplied as a continuous spool 110 of filament material. The filament 102 may be wound around the spool 110. In many embodiments, the needle 112 may be a hollow needle.

In many embodiments, the apparatus may be stocked with a plurality of filaments and a plurality of T-bar elements to generate at least one fastener for securing at least one product to at least one packaging.

Figure 2:
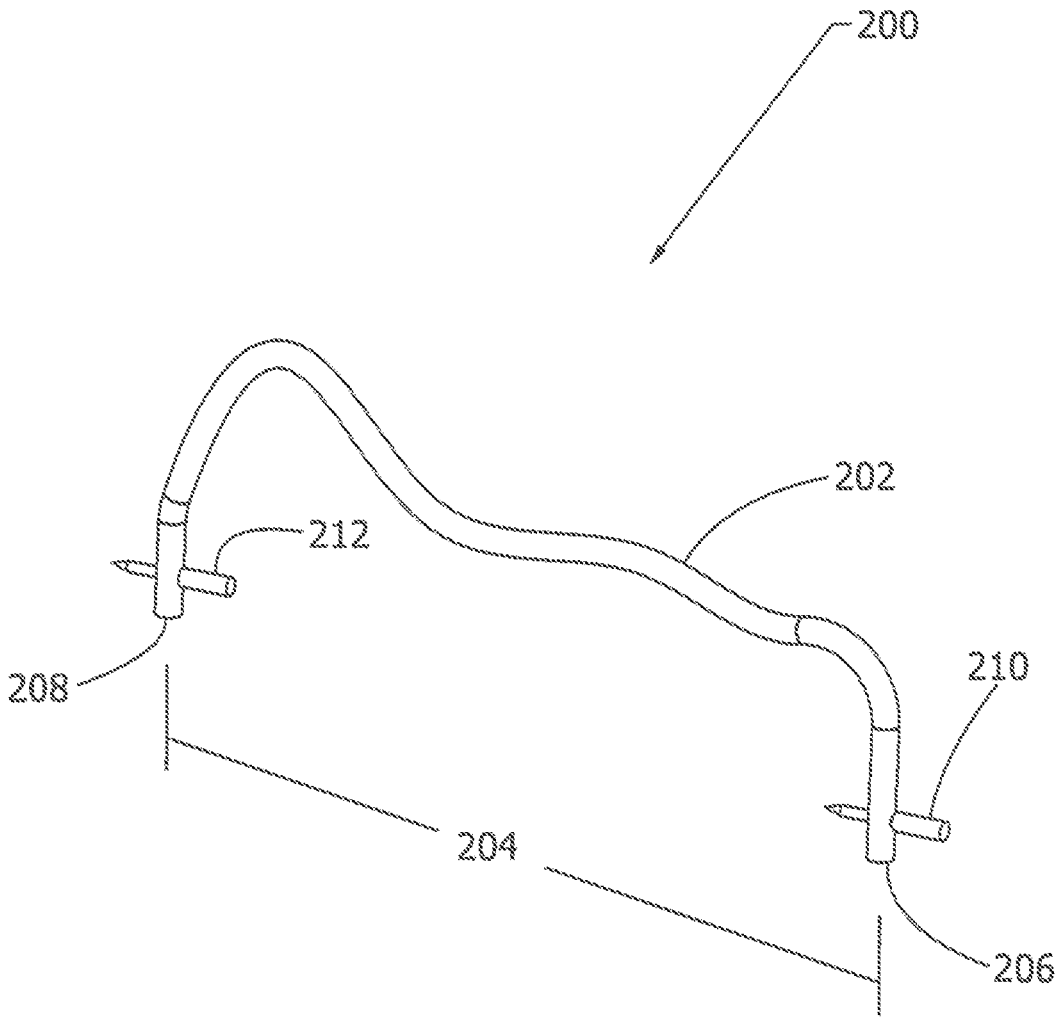
FIG. 2 illustrates a perspective view of the fastener in accordance with the disclosed architecture.

Generally referring to FIG. 2, each fastener 200 may comprise a filament section 202, a first T-bar element 210, and a second T-bar element 212. The filament section 202 comprises a first end 206, a second end 208, and a length 204. The length 204 of the filament section 202 may be variable, allowing a user to select and adjust the length 204 depending on a length needed to adequately secure at least one product 10 to at least one packaging 20 at appropriate securing positions. In many embodiments, the first T-bar element 210 may be attachable to the filament section 202 at the first end 206. In many embodiments, the second T-bar element 212 may be attachable to the filament section 202 at the second end 208. The first T-bar element 210 and second T-bar element 212 may be engaged, attached, or otherwise secured to the filament section by bonding, welding, gluing, piercing, clamping, insertion, and the like, or by any other suitable method of securing means as is known to one of skill in the art without affecting the overall concept of what is disclosed herein.

In one embodiment, a-structure of the apparatus 100 and the fastener 200, the use of the apparatus 100 to manufacture the fastener 200 and use it to secure at least one product 10 to at least one packaging 20 may be provided in FIGS. 3A and 3B. According to many embodiments, FIGS. 3A and 3B illustrate at least one product 10 secured to at least one packaging 20 with the fastener 200.

In many embodiments, method of generating a fastener and securing at least one product to at least one packaging comprising the steps of: 1) stocking an apparatus with a filament and a plurality of T-bar elements, wherein the apparatus comprises an applicator module and a needle; 2) penetrating the packaging with the needle at a first position; 3) deploying a first T-bar element through the needle; and 4) engaging the first T-bar element to the filament at the first position. In many embodiments, engaging the first T-bar element to the filament at the first position may comprise engaging the first T-bar element to the filament at the first position.

In some embodiments, the method described herein may further comprise the step of moving the needle to a second position. The needle may be moved to a second position in order to accommodate the shape of at least one product.

In some embodiments, the method described herein may further comprise the step of penetrating the packaging with the needle at the second position. The packaging may be penetrated also to accommodate the shape of at least one product for the fastener described herein. In some embodiments, the method described herein may further comprise the step of deploying a second T-bar element through the needle. In some embodiments, the method described herein may further comprise the step of engaging or attaching the second T-bar element to the filament at the second position. By engaging or attaching the second T-bar element, the fastener may be secured to at least one product and at least one packaging by the methods described above.

In some embodiments, the method described herein may further comprise the step of severing the filament at the second position. After severing the filament at the second position, the apparatus may provide another fastener to at least one product to secure it in at least one packaging.

In some embodiments, the method described herein for generating a fastener and securing at least one product to at least one packaging comprises the steps of: 1) stocking an apparatus with a filament and a plurality of T-bar elements, wherein the apparatus comprises an applicator module and a needle; 2) penetrating the packaging with a needle at a first position; 3) deploying a first T-bar element through the needle; 4) engaging the first T-bar element to the filament at the first position; 5) moving the needle to a second position; 6) penetrating the packaging with the needle at the second position; 7) deploying a second T-bar element through the needle; 8) engaging a second T-bar element to the filament at the second position; and 9) severing the filament at the second position. In many embodiments, engaging the first T-Bar element to the filament at the first position may include attaching the first T-Bar element to the filament at the first position. In many embodiments, engaging the second T-Bar element to the filament at the second position may include attaching the second T-Bar element to the filament at the second position.

In some embodiments, the user loads the apparatus 100 with the filament 102 and the plurality of T-bar elements 104. The applicator module 114 may then accept the filament 102 from the spool 110 and feed the filament 102 through the applicator module and interacts with needle 112.

In some embodiments, at least one product 10 is then positioned onto at least one packaging 20. The user may locate the needle 112 at a first position 22 on at least one packaging 20 and penetrate at least one packaging 20 with the needle 112 and the filament 102, thereby seating the needle 112 in at least one packaging 20. Next, the user may activate the applicator module 114 to eject the first T-bar element 210 from the applicator module 114 through the needle 112. In many embodiments, the needle 112 is a hollow needle. In some embodiments, the first T-bar element 210 is deployed through the needle apart from the filament 102. In other embodiments, the first T-bar component 210 may be deployed through the needle to interact with the filament 102. The first T-bar element 210 is then engaged or attached to the filament 102 at the first position 22. As described supra, the first T-bar element 210 typically pierces, penetrates, clamps, or is otherwise affixed to filament 102.

Once the first T-bar element 210 is fixed to the filament 102 at the first position 22, the first T-bar element 210 may position or toggle itself so that it is substantially orients perpendicular to the filament 102. In doing so, the first T-bar element 210 may engage and essentially lock itself to a backside of at least one packaging 20. As the first T-bar element 210 engage and essentially locks itself, the first T-bar element 210 may be preventing the withdrawal of the filament 102 at the first position 22. At this point, the needle 112 may be withdrawn from at least one packaging 20 and moved across at least one product 10 dragging the filament 102 over at least one product 10 to a second position 24.

In some embodiments, the user may now penetrate at least one packaging 20 with the needle 112 and the filament 102, thereby seating the needle 112 in at least one packaging 20 at the second position 24. Further, the user may again activate the applicator module 114 to eject the second T-bar element 212 from the applicator module 114 through the needle 112. In some embodiments, the second T-bar element 212 may be deployed through the needle apart from the filament 102. In other embodiments, the second T-bar component 212 may be deployed through the needle to interact with the filament 102. In many embodiments, the second T-bar element 212 may then be engaged or attached to the filament 102 at the second position 24 in a similar means as the first T-bar element 210. Like the first T-bar element 210, the second T-bar element 212 may position or toggle itself so that it is substantially orients perpendicular to the filament 102. In doing so, the second T-bar element 212 may engage and essentially lock itself to the backside of at least one packaging 20. As the second T-bar element 212 engages and essentially locks itself, the second T-bar element 212 may be preventing the withdrawal of the filament 102 at the second position 24. The filament 102 may then be severed or cut distal to the second T-bar element 212 leaving the fastener 200 in place securing at least one product 10 to at least one packaging 20 at the first position 22 and the second position 24 while the needle 112 is withdrawn from at least one packaging 20.

The user may select the length 204 of the fastener 200. The length 200 of the fastener 200 may be dependent on a distance between the first position 22 and the second position 24. In many embodiments, the apparatus described herein does not require modification to change the length of the fastener. The apparatus 100 may additionally be used to manufacture a different length fastener 230 comprising a second length 232 without modifying the apparatus 100 or needing to restock with different fastener components. To further secure at least one product 10 to at least one packaging 20, the different length fastener 230 is manufactured in a similar manner as the fastener 200 used at the first position 22 and the second position 24. The user moves the needle 112 to a third position 26 and a fourth position 28 repeating the steps as described supra. The second length 232 is dependent on a distance between the third and fourth positions 26 and 28 and by the bulk of the product 20 spanned by the filament 102. The method is repeatable indefinitely to create any variety of different length fasteners as required by a given application.

The fastener 200 described herein may be comprised of at least one thermoplastic material such as, but not limited to, polypropylene, nylon, PET, polyurethane, recyclable plastics, bio-based plastics, and biodegradable plastics, PHA, PHB, and PVA materials.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method of generating a fastener and securing at least one product to at least one packaging comprising the steps of:

stocking an apparatus with a filament and a plurality of T-bar elements, wherein the apparatus comprises an applicator module and a needle;

penetrating the packaging with the needle at a first position;

deploying a first T-bar element through the needle; and engaging the first T-bar element to the filament at the first position.

2. The method of claim 1, further comprising the step of moving the needle to a second position.

3. The method of claim 1, further comprising the step of penetrating the packaging with the needle at the second position.

4. The method of claim 1, further comprising the step of deploying a second T-bar element through the needle.

5. The method of claim 4, wherein the first T-bar element and the second T-bar element are deployed through the needle apart from the filament.

6. The method of claim 1, further comprising the step of engaging a second T-bar element to the filament at a second position.

7. The method of claim 6, wherein the first T-bar element and the second T-bar element are bonded to the filament.

8. The method of claim 6, wherein the first T-bar element and the second T-bar element pierce the filament.

9. The method of claim 6, wherein the first T-bar element and the second T-bar element are clamped to the filament.

10. The method of claim 6, wherein the first T-bar element and the second T-bar elements are oriented substantially perpendicular to the filament once engaged with the filament.

11. The method of claim 6, wherein the fastener comprises the filament, the first T-bar element, and the second T-bar element;

wherein the filament comprises a first end, a second end, and a length between the first and second ends.

12. The method of claim 11, wherein the length of the fastener is selected by a user.

13. The method of claim 11, wherein the apparatus does not require modification to change the length of the fastener.

14. The method of claim 1, further comprising the step of severing the filament at a second position.

15. The method of claim 1, wherein the filament is fed through the applicator module and interacts with the needle.

16. The method of claim 1, wherein the apparatus is stocked with a plurality of filaments and a plurality of T-bar elements to generate at least one fastener for securing at least one product to at least one packaging.

17. A method generating a fastener and securing at least one product to at least one packaging comprising the steps of:

stocking an apparatus with a filament and a plurality of T-bar elements, wherein the apparatus comprises an applicator module and a needle;

penetrating the packaging with a needle at a first position;

deploying a first T-bar element through the needle;

engaging the first T-bar element to the filament at the first position;

moving the needle to a second position;

penetrating the packaging with the needle at the second position;

engaging a second T-bar element to the filament at the second position; and severing the filament at the second position.

18. The method of claim 17, wherein the first T-bar element and the second T-bar element are bonded to the filament.

19. The method of claim 17, wherein the first T-bar element and the second T-bar element pierce the filament.

20. The method of claim 17, wherein the first T-bar element and the second T-bar element are clamped to the filament.

21. The method of claim 17, wherein the first T-bar element and the second T-bar elements are oriented substantially perpendicular to the filament once engaged with the filament.

22. The method of claim 17, wherein the fastener comprises the filament, the first T-bar element, and the second T-bar element;

wherein the filament comprises a first end, a second end, and a length between the first and second ends.

23. The method of claim 22, wherein the length of the fastener is selected by a user.

24. The method of claim 22, wherein the apparatus does not require modification to change the length of the fastener.

25. The method of claim 17, wherein the filament and the first T-bar element and the second T-bar element are deployed through the needle apart from the filament.

26. The method of claim 17, further comprising the step of securing at least one additional fastener to the packaging.

27. An apparatus for constructing a plurality of different length fasteners comprising:

a needle; and an applicator module, wherein the applicator module feeds a filament into the needle, ejects a first T-bar element and a second T-bar element through the needle, and attaches the first T-bar element and the second T-bar element to the filament at a first position and a second position.

28. The apparatus of claim 27, wherein the apparatus further comprises a deployment activator.

29. The apparatus of claim 27, wherein the apparatus further comprises a cutting component.

30. The apparatus of claim 27, wherein the apparatus further comprises a spool for retaining and pre-tensioning the filament.

* * * * *